US010221035B1

(12) United States Patent
Berger

(10) Patent No.: US 10,221,035 B1
(45) Date of Patent: Mar. 5, 2019

(54) YARN SWIFT

(71) Applicant: Lorraine Berger, Mesa, AZ (US)

(72) Inventor: Lorraine Berger, Mesa, AZ (US)

( * ) Notice: Subject to any disclaimer, the term of this patent is extended or adjusted under 35 U.S.C. 154(b) by 110 days.

(21) Appl. No.: 15/587,847

(22) Filed: May 5, 2017

Related U.S. Application Data

(60) Provisional application No. 62/333,029, filed on May 6, 2016.

(51) Int. Cl.
*B65H 49/30* (2006.01)

(52) U.S. Cl.
CPC ..... *B65H 49/30* (2013.01); *B65H 2701/31* (2013.01)

(58) Field of Classification Search
CPC ..... B65H 49/30; B65H 49/305; B65H 54/58; B65H 54/585; B65H 54/60; B65H 2701/31
See application file for complete search history.

(56) References Cited

U.S. PATENT DOCUMENTS 1,539,016 A * 5/1925 Mizuno ..... B65H 49/30 242/127
1,962,513 A * 6/1934 Lyon ..... B65H 49/30 242/575
2,033,640 A * 3/1936 Mears ..... B65D 85/04 206/227
2,545,744 A * 3/1951 Nell ..... B65H 49/30 242/118.5

FOREIGN PATENT DOCUMENTS

CH 177539 A * 6/1935 ..... B65H 49/30
FR 2874004 A1 * 2/2006 ..... B65H 49/28

* cited by examiner

*Primary Examiner* — William E Dondero
(74) *Attorney, Agent, or Firm* — Venjuris, P.C.

(57) ABSTRACT

This invention is embodied in an improved yarn swift that provides integrated storage of all components; smooth and non-tipping rotation when in use; foldable appendages that are secured in their folded position for compact storage; minimized assembly and adjustments needed for use; ability to use on any flat surface as opposed to being clamped to a work-bench edge; and no screw-tightening needed to operate. In this way, the improved yarn swift enables its user to quickly and easily wind a hank of yarn.

6 Claims, 6 Drawing Sheets

YARN SWIFT

CROSS-REFERENCE TO RELATED APPLICATIONS

The present application claims priority to U.S. non-provisional patent application entitled "Improved Yarn Swift" having Ser. No. 62/333,029, filed on May 6, 2016, which is entirely incorporated herein by reference.

FIELD OF INVENTION

This invention generally relates to the field of yarn swifts, and more specifically to a table-top yarn swift.

BACKGROUND

A swift is a knitter's tool used to hold a hank of yarn while it is being wound off. Swifts are generally adjustable in diameter so that they can hold hanks of many sizes, and rotate around a central point. They are generally made out of wood or metal, however other materials may also be used. Common types of swift designs are umbrella swifts, Amish swifts, or Ferris wheel swifts.

Existing swift designs have some inherent limitations. Amish swifts use pegs that are stored separately from the other components of the swift, with the potential for losing the pegs. The Amish swifts rotate about a small central screw or small post that often results in wobbling rotation, or tendency to tip over when in use. The Amish swifts also utilize non-folding arms that either need to be stored in their large X-shaped functional position, or need to be taken apart for storage.

Umbrella swifts are normally clamped to the side of a work-bench, necessitating that the work surface edge accommodate the dimensions of the clamp. Ferris wheel swifts share many of these same limitations. Existing swifts also utilize screw-based clamps or adjustment devices that can be difficult to adjust by people with arthritis or other such impairments, Therefore, it would be desirable to provide a swift design that is free of these limitations. Such a yarn swift would provide integrated storage of all components; smooth and non-tipping rotation when in use; foldable appendages that are secured in their folded position for compact storage; minimized assembly and adjustments needed for use; the ability to use on any flat surface as opposed to being clamped to a work-bench edge; and no screw-tightening needed that can be difficult for some people.

SUMMARY

The present invention is incorporated in an improved swift device illustrated in the accompanying schematics. The invention presented in this specification provides an original solution to the limitations of existing swift designs.

In general, the improved yarn swift provides integrated storage of all components; smooth and non-tipping rotation when in use; foldable appendages that are secured in their folded position for compact storage; minimized assembly and adjustments needed for use; ability to use on any flat surface as opposed to being clamped to a work-bench edge; and no screw-tightening needed to operate.

The features, functions, and advantages may be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

The present invention provides a significant improvement over prior art swifts because it provides integrated storage of all components; smooth and non-tipping rotation when in use; foldable appendages that are secured in their folded position for compact storage; minimized assembly and adjustments needed for use; ability to use on any flat surface as opposed to being clamped to a work-bench edge; and no screw-tightening needed to operate.

Figure 1:
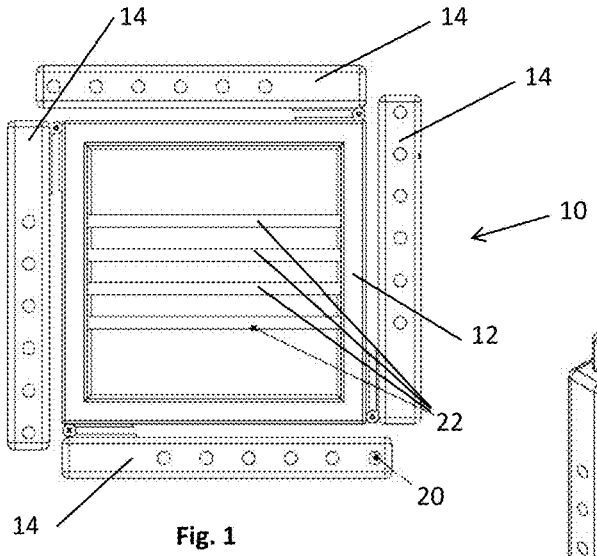
FIG. 1 is a top view of an embodiment of an improved yarn swift 10 in the closed position.
Figure 2:
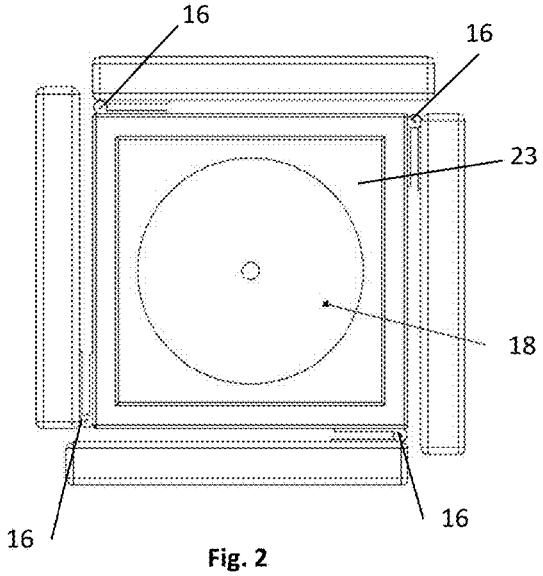
FIG. 2 is a bottom view of the embodiment shown in FIG. 1.
Figure 3:
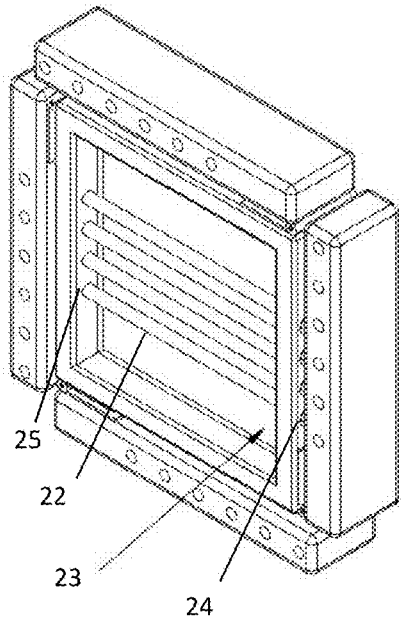
FIG. 3 is an isometric view of the embodiment shown in FIG. 1.

Turning now to FIGS. 1-3, the preferred embodiment of an improved yarn swift 10 starts with an interior frame 12. Folding arms 14 are rotatably attached to the interior frame 12 by hinges 16. The interior frame 12 is rotatably connected to a base 18. It is preferred to use a spinning connection with internal bearings, sometimes referred to in the art as a "Lazy Susan", but other spinning connections known in the art can be used. The spinning connection allows the interior frame 12 to rotate freely relative to the base 18. A tray board 23 provides physical separation between the upper part of interior frame 12 and base 18 such that objects are prevented from potentially become lodged between the frame 12 and base 18.

Figure 4:
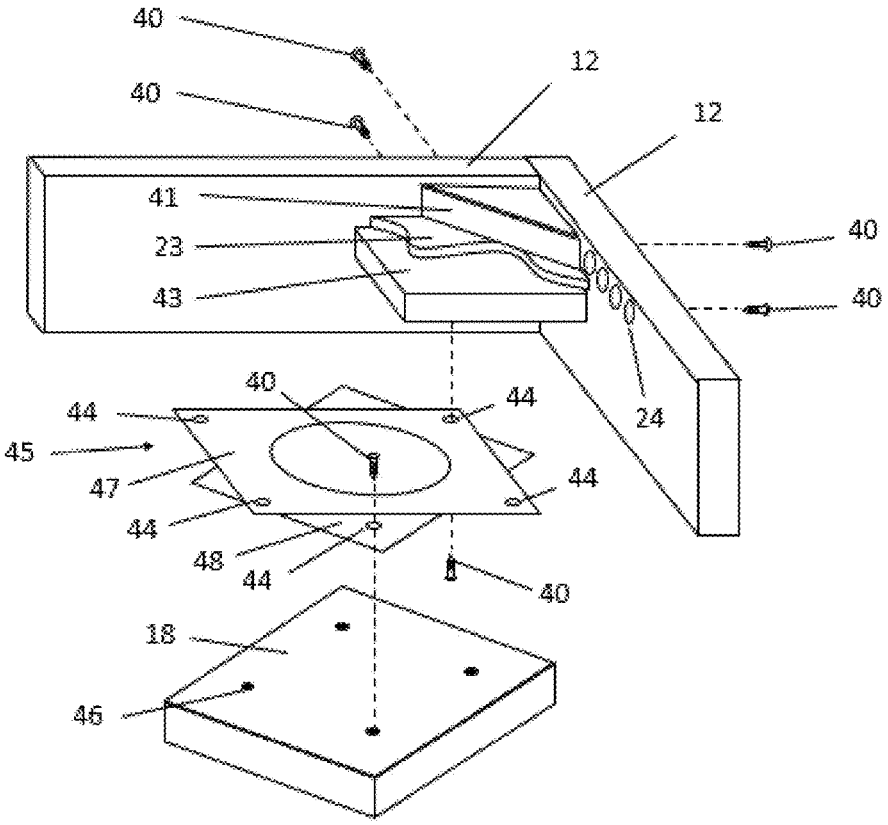
FIG. 4 depicts construction details of an improved yarn swift frame.

The interior frame 12 is constructed such that it provides a rigid structure upon which to mount the hinges 16. Refer to FIG. 4 that depicts construction details of the preferred embodiment of one corner of the improved yarn swift interior frame 12. Two sides of the interior frame 12 are joined at a square angle and fastened to bottom corner gusset 43, using screws 40, driven in to the bottom corner gusset 43, from each side of the frame 12. A corner of tray board 23 is shown in position above bottom corner gusset 43, where the complete tray board 23 extends to each corner of frame 12 to fill the interior of frame 12. Upper corner gusset 41 is placed above tray board 23, and the two sides of the interior frame 12 are joined to upper corner gusset 41, using screws 40, driven into upper corner gusset 41, from each side of the frame 12.

Referring still to FIG. 4, spinning connection 45 is comprised of upper plate 47 and lower plate 48 that can rotate independently of each other as is known in the art, and are shown turned relative to each other in FIG. 4. Bottom plate 48 is fastened to base 18 using screws 40 driven through screw holes 44 into screw pockets 46 in base 18. Top plate 47 is fastened to the bottom of each of four bottom corner gussets 43 in each corner of frame 12, using screws 40, driven through screw holes 44 in top plate 47.

Figure 5:
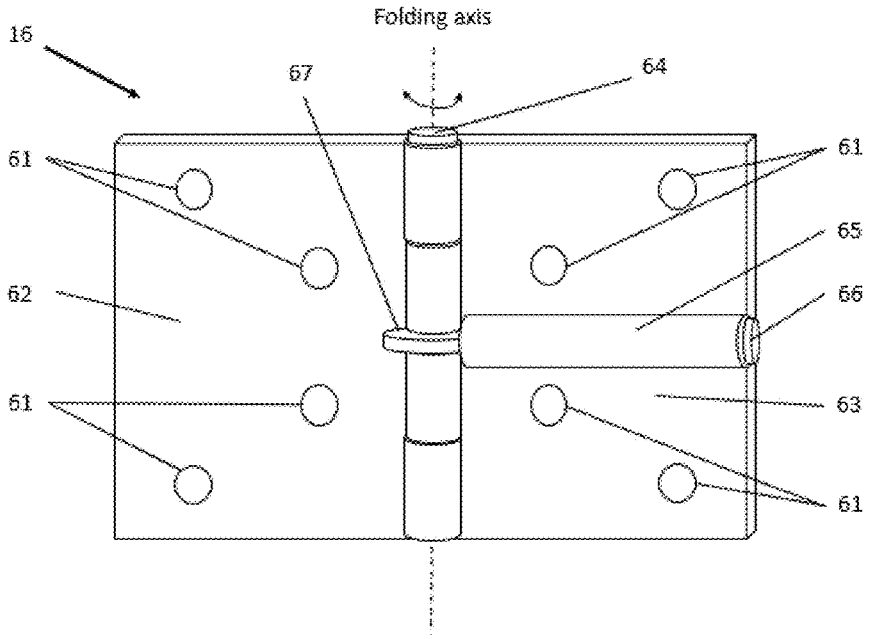
FIG. 5 depicts details of an improved yarn swift locking hinge.

FIGS. 1-3 depict the improved yarn swift in the closed position, and it is preferred to be able to lock folding arms 14 in the closed position. This can be achieved by a variety of ways known in the art. For example, a locking mechanism internal to the hinge mechanism would work. FIG. 5 depicts details regarding the preferred locking hinge 16. The preferred locking hinge 16 is comprised of two plates 62 and 63 that fold relative to each other around the depicted folding axis, secured by hinge pin 64. Hinge plate 63 incorporates a spring and bearing contained internal to spring barrel 65, and held in place with spring retention screw 66. The bearing contained internal to spring barrel 65 is able to roll against guide cam 67, which is affixed to plate 62, as the hinge is folded along its axis. Notches in guide cam 67 result in the bearing in spring barrel 65 lodging into the cam notches, holding the hinge folded in various positions. Of interest for the improved yarn swift are positions at 0 degrees of fold (fully closed), and 90 degrees (half open) or 180 degrees open (fully open). When locking hinge 16 is affixed to interior frame 12 by screws driven through hinge screw holes 61 on hinge plate 63, and to one of folding arms 14 by screws driven through hinge screw holes 61 on hinge plate 62, the arms can be rotated and held open or closed.

A catch mechanism on the arm or the central structure, such as an attached magnet or a hook can also be used to secure folding arm 14 in the closed position. Folding arms 14 can also lock in the open position (depicted later), by means of a locking mechanism, such as a spring-loaded lock mechanism internal to the hinge, described previously. Clearance notches may be cut into folding arm 14 to accommodate the closed depth of hinge 16 so that folding arm 14 may be held closely to internal frame 12 in the closed position.

Folding arms 14 preferably have a series of holes 20 in them for accepting a peg 22. The holes preferably extend most of the depth of the arms. These holes 20 form pockets into which pegs 22 may be inserted and held in an upright position. As shown in FIG. 3, the pegs 22 can be stored (i.e. "removably connected) to the interior frame 12 by sliding them through peg access holes 24, and into peg retention pockets 25 on the opposite side of interior frame 12. It is preferred that the access holes 25 extend through the interior frame 12 and the retention pockets 25 only go part-way through the interior frame 12. That way the pegs can be pushed though access holes 24 but not pushed through retention pockets 25. When stored, one or more of the folding arms 14 can retain the pegs 22 along with interior frame 12 by blocking peg access holes 24.

Figure 6:
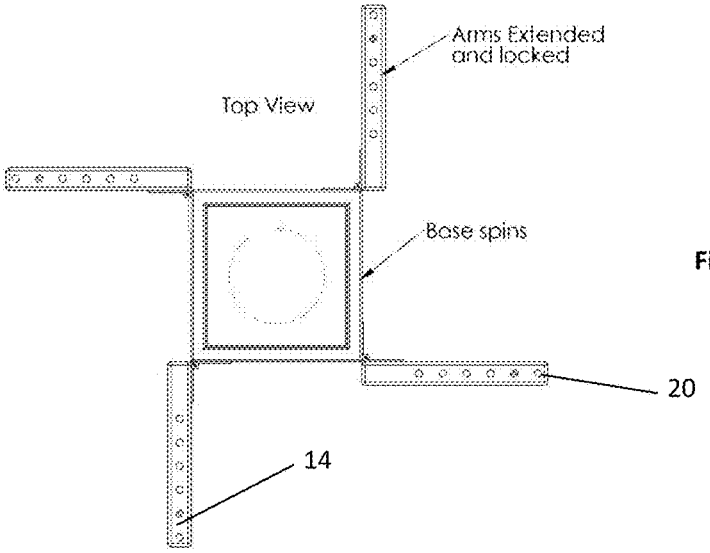
FIG. 6 illustrates a top view of an improved yarn swift embodiment in the open configuration.
Figure 7:
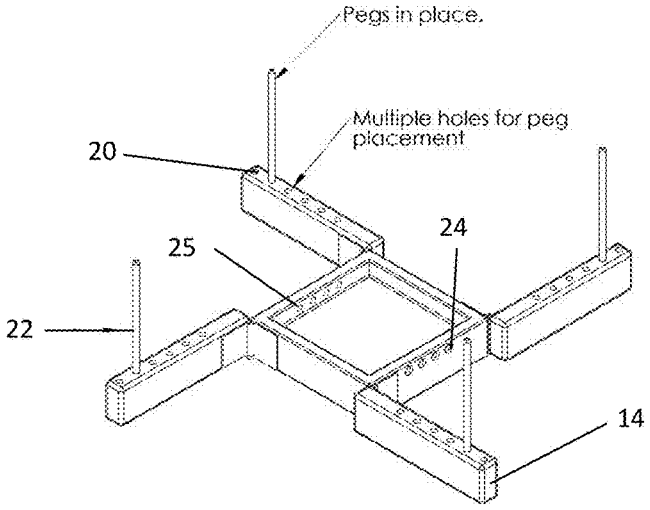
FIG. 7 illustrates an isometric view of an improved yarn swift embodiment in the open configuration.
Figure 8:
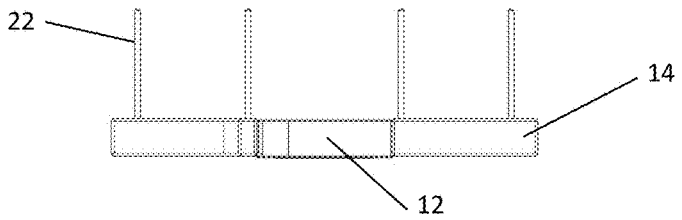
FIG. 8 illustrates a side view of an improved yarn swift embodiment in the open configuration.

The improved yarn swift has at least two modes: a closed configuration and an open configuration. FIGS. 1-3 illustrate several views of the preferred embodiment of the improved yarn swift in the closed position. FIGS. 6-8 illustrate several views of the preferred embodiment of the improved yarn swift in the open position. For example, FIGS. 6-8 include views of the preferred improved yarn swift 10 in its open configuration, with the pegs 22 inserted in the arms 14.

Figure 9:
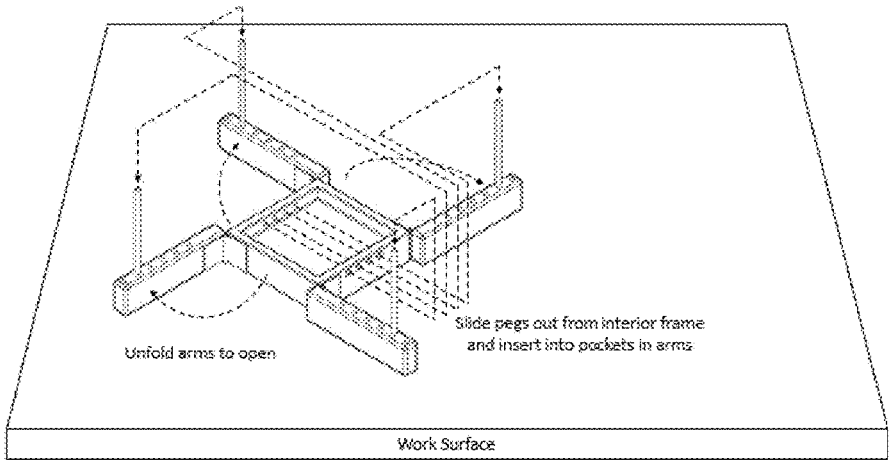
FIG. 9 illustrates how to convert an improved yarn swift embodiment from a closed position to an open position.

FIG. 9 illustrates how to set up the improved yarn swift 10 for use. As shown in FIG. 9, to open the swift, the user places the swift 10 with the spinner base 18 down on a solid work surface. The user unfolds the arms 14 from the closed to open position. The pegs 22 may then be slid out from the interior frame 12 and inserted in any desired combination of holes 20 in the arms 14.

Figure 10:
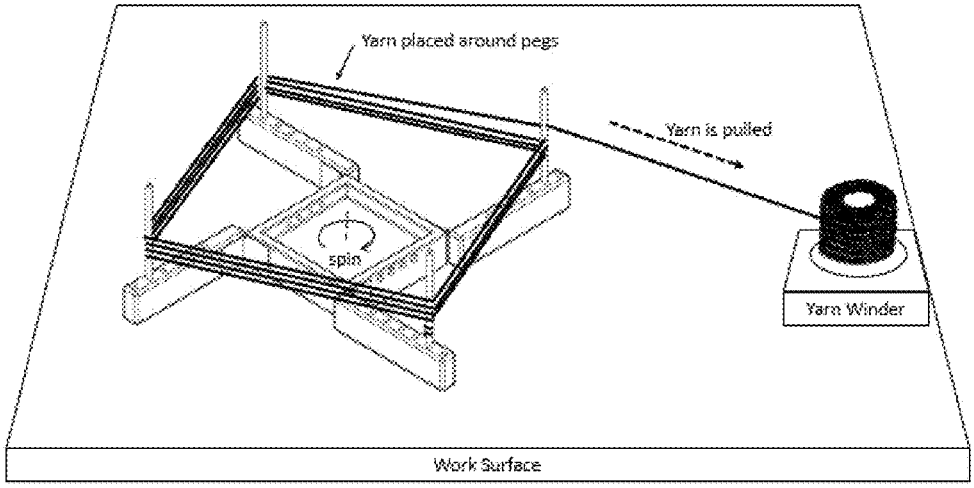
FIG. 10 illustrates how to use an embodiment of the improved yarn swift.

FIG. 10 illustrates the improved yarn swift 10 being used for winding. The yarn or fiber that is to be wound is placed around the pegs 22 in the arms 14. The pegs 22 are arranged to various holes 20 in the arms 14 to provide the desired level of tension to the yarn or fiber. The yarn or fiber is arranged such that it can be pulled outward from the swift. The user may then begin winding the yarn or fiber using a yarn winder or other device by pulling on the free end of the material. The swift will spin freely as the yarn or fiber is pulled. The swift can spin in either the clockwise or counter-clockwise directions, as desired.

While embodiments of the disclosure have been described in terms of various specific embodiments, those skilled in the art will recognize that the embodiments of the disclosure may be practiced with modifications within the spirit and scope of the claims.

What is claimed is:

1. An improved yarn swift, the yarn swift comprising:

an interior frame, the interior frame having an outside perimeter, the interior frame rotatably connected to a base, the interior frame further comprising a pair of opposing sides wherein each opposing side has a matching hole for accepting a peg, at least two arms rotatably connected to the outside perimeter by a hinge, each arm further comprising a plurality of top holes for accepting a peg, at least two pegs, each peg for inserting into respective top holes in different arms, wherein the yarn swift has two modes: a closed configuration and an open configuration, the closed configuration being where the arms are rotated toward the interior frame and the open position being where the arms are rotated away from the interior frame.

2. The improved yarn swift of claim 1, wherein one of the matching holes goes all the way through the interior frame and the other one of the matching holes goes only partway through the interior frame.

3. The improved yarn swift of claim 2, wherein one of the arms in the closed position holds the peg in the matching holes for storage.

4. The improved yarn swift of claim 1, wherein the hinge is a locking hinge.

5. The improved yarn swift of claim 1, the hinge comprising lock settings at 0 degrees and 180 degrees.

6. A method of winding yarn with a yarn swift having an open position and a closed position, the method comprising:

starting with the yarn swift in the closed position, the closed position comprising an interior frame, the interior frame having an outside perimeter, the interior frame rotatably connected to a base, the interior frame further comprising a pair of opposing sides wherein each opposing side has a matching hole for accepting a peg, at least two arms rotatably connected to the outside perimeter by a hinge, each arm further comprising a plurality of top holes for accepting a peg, at least two pegs, each peg for inserting into respective top holes in different arms, wherein each peg is initially located in one of the matching holes, and wherein the arms are rotated against the interior frame to keep the pegs from sliding out of the matching holes, rotating the arms away from the interior frame, removing the pegs from the matching holes, inserting each peg into one of the plurality of top holes,
placing a hank of yarn around the pegs, and
winding the yarn.

* * * * *